166-27
11/10/81 OR 4,299,286

United States Patent [19]

Alston

[11] 4,299,286

[45] Nov. 10, 1981

[54] ENHANCED OIL RECOVERY EMPLOYING BLEND OF CARBON DIOXIDE, INERT GAS AND INTERMEDIATE HYDROCARBONS

[75] Inventor: Robert B. Alston, Missouri City, Tex.

[73] Assignee: Texaco Inc., White Plains, N.Y.

[21] Appl. No.: 152,072

[22] Filed: May 21, 1980

[51] Int. Cl.[3] ..... E21B 43/22

[52] U.S. Cl. ..... 166/274; 166/268

[58] Field of Search ..... 166/273–275, 166/266, 252, 268

[56] References Cited

U.S. PATENT DOCUMENTS

| | | | |
|---|---|---|---|
| 2,623,596 | 12/1952 | Whorton et al. | 166/266 X |
| 2,875,830 | 3/1959 | Martin | 166/266 |
| 2,875,832 | 3/1959 | Martin et al. | 166/266 |
| 3,811,501 | 5/1974 | Burnett et al. | 166/274 X |
| 3,811,503 | 5/1974 | Burnett et al. | 166/274 X |
| 3,841,403 | 10/1974 | Burnett et al. | 166/273 X |
| 3,854,532 | 12/1974 | Braden, Jr. | 166/274 |
| 3,856,086 | 12/1974 | Braden, Jr. | 166/274 |
| 4,086,961 | 5/1978 | Braden, Jr. et al. | 166/274 X |
| 4,136,738 | 1/1979 | Haynes, Jr. et al. | 166/273 |

*Primary Examiner*—Stephen J. Novosad

*Attorney, Agent, or Firm*—Carl G. Ries; Robert A. Kulason; Jack H. Park

[57] ABSTRACT

Oil may be recovered from dipping reservoirs by a conditionally miscible oil recovery process in which a gaseous, carbon dioxide-containing fluid is injected up-dip to displace petroleum downward in a conditionally miscible, gravity-stabilized displacement process. Carbon dioxide-containing blending stock is mixed with an inert gas such as methane or nitrogen in order to reduce its density sufficiently to increase the critical velocity of the displacement process. By increasing the critical velocity, the time required to deplete a reservoir is decreased significantly. Sufficient intermediate hydrocarbons are added to the mixture of carbon dioxide and inert gas to insure that the mixture injected into the formation is conditionally miscible at formation temperature and pressure.

15 Claims, 3 Drawing Figures

ENHANCED OIL RECOVERY EMPLOYING BLEND OF CARBON DIOXIDE, INERT GAS AND INTERMEDIATE HYDROCARBONS

FIELD OF THE INVENTION

This invention concerns an enhanced oil recovery process. More specifically, this invention is concerned with an enhanced oil recovery process employing a critical mixture of carbon dioxide, inert gas and intermediate hydrocarbons in a gravity-stabilized, conditionally miscible displacement of oil in a dipping reservoir.

BACKGROUND OF THE INVENTION

In the recovery of oil from subterranean reservoirs, one of the more successful methods employed to-date is miscible flooding, which involves injecting a solvent into the formation to dissolve oil and facilitate its efficient extration from the reservoir. When the solvent injected into the formation is capable of forming a single phase with the reservoir fluid at formation conditions immediately on contact therewith, the condition is referred to as instant miscibility.

Miscible flooding is a very effective oil recovery process for removing oil from subterrean reservoirs. By creating a single phase system in the reservoir, the retentive forces of capillarity and interfacial tension, which cause a significant reduction in recovery by non-miscible flooding processes, are eliminated. Furthermore, the mixing of the injected fluid with the formation oil reduces the viscosity of the oil, as a result of which the oil flows or can be displaced more efficiently through the permeable oil reservoir.

While hydrocarbons, e.g. paraffinic hydrocarbons in the C2 to C6 range have been employed successfully in miscible flooding, these materials are quite expensive and the cost of a miscible flood employing a substantial amount of light hydrocarbons is exceedingly high. Carbon dioxide has also been used successfully as an oil recovery agent. Carbon dioxide is a particularly desirable material because it is highly soluble in oil, and dissolution or carbon dioxide in oil causes a reduction in the viscosity of the oil and increases the volume of oil, all of which improve the recovery efficiency of the process. Carbon dioxide is sometimes employed under non-miscible conditions, and in certain reservoirs it is possible to achieve a condition of miscibility at reservoir temperature and pressure between essentially pure carbon dioxide and the oil.

More recently, prior art references have recognized the fact that carbon dioxide may be employed as a recovery agent under conditions in which only conditional miscibility is achieved at reservoir conditions. Conditional miscibility is distinguished from instant miscibility by the fact that miscibility between the injected carbon dioxide and the reservoir petroleum is achieved sometime after the first contact between carbon dioxide and the reservoir petroleum, as a result of a series of transitional multi-phase conditions, wherein the injected fluid vaporizes intermediate hydrocarbon components from the reservoir petroleum to form a mixture of carbon dioxide and intermediate hydrocarbon components, with the concentration of intermediate hydrocarbon components increasing with time as the bank moves through the reservoir until a miscible condition is achieved in situ as a consequence of the contact between the injected fluid and the reservoir petroleum.

When the fluid injected into the reservoir is gaseous at reservoir conditions, injection conditions must be controlled carefully to achieved efficient displacement even if conditional miscibility can be achieved. This relates to the fact that gaseous displacing fluids ordinarily are inefficient displacing agents under many conditions encountered in subterranean reservoirs. If the reservoir itself is a dipping reservoir, i.e., if the angle between the reservoir and the horizontal plane is greater than 5° and preferably greater than 10°, stable conditions can be achieved if the gaseous fluid is injected up-dip to displace the petroleum in a downward direction, so long as the linear velocity of the injected bank through the formation does not exceed a critical velocity value. The critical velocity is proportional to the formation permeability, the difference in density between the displacing and displaced fluid, and the sine of the dip angle of the formation, and is inversely related to the mobile fluid porosity and the difference in viscosity between the displaced and displacing fluid. Since carbon dioxide is a highly compressible gas, the density of gaseous carbon dioxide under many reservoir conditions is nearly equal to the density of liquid formation petroleum, and so the density difference is quite low. The low density difference means the critical velocity required to insure maintenance of a stable displacing front is very low, and so the fluid injection rate must be maintained at a level too low for economical operating conditions. While prior art references teach the dilution of carbon dioxide with inert gas to reduce the density of the injected fluid, addition of inert gas to carbon dioxide reduces the miscibility of the fluid, and in critical situations can result in changing the injected fluid from one which is conditionally miscibile with the formation petroleum, to one which is no longer conditionally miscible.

In view of the foregoing discussion, it can be appreciated that there is a significant need for an oil recovery method employing carbon dioxide under conditions of conditional miscibility where the conditional miscibility is maintained after the density difference is increased to permit flooding at a reasonably high rate so as to insure that the oil recovery process is economically feasible.

DESCRIPTION OF THE PRIOR ART

U.S. Pat. No. 3,811,501, Burnett, et al, May 21, 1974, describes an enhanced oil recovery process employing a conditionally miscible mixture of carbon dioxide and an inert gas.

U.S. Pat. No. 3,811,502 describes an enhanced oil recovery process employing essentially pure carbon dioxide under conditions where carbon dioxide is conditionally miscible with the reservoir petroleum.

U.S. Pat. No. 3,811,503 describes an oil recovery process employing carbon dioxide in a situation in which pure carbon dioxide is not conditionally miscible with the formation petroleum at the formation temperature and pressure, in which sufficient intermediate hydrocarbons are blended with carbon dioxide to insure that the injected mixture is conditionally miscible with the formation petroleum at the formation temperature and pressure.

U.S. Pat. No. 3,841,406, Burnett, Oct. 15, 1974 describes an oil recovery process in which first a slug of gas having limited solubility is injected into the formation to increase the formation pressure, after which a slug of carbon dioxide is injected. By first increasing the pressure in the formation, conditional miscibility can be achieved between the carbon dioxide and the formation petroleum.

U.S. Pat. No. 3,841,403, Burnett et al, Oct. 15, 1974, describes an enhanced oil recovery process comprising injecting a lean gas into a formation to form a miscible transition zone with asphaltine-free components of the oil followed by injecting a driving fluid into the reservoir.

U.S. Pat. No. 4,136,738 describes a two slug enhanced oil recovery process, in which first a slug of hydrocarbon is injected at a high rate, above the critical velocity, to insure efficient mixing between the injected fluid and the formation petroleum, followed by injecting carbon dioxide at a slow rate to insure efficient displacement of the mixture of the first slug and the formation petroleum.

SUMMARY OF THE INVENTION

Briefly, my invention concerns a process for recovering petroleum from a subterranean, permeable, oil bearing petroleum reservoir penetrated by at least one injection well and at least by one production well, comprising injecting into the reservoir via said injection well a gaseous displacing agent comprising a mixture of carbon dioxide, an inert gas, and an intermediate hydrocarbon such as a hydrocarbon having from 2 to 6 carbon atoms, wherein the inert gas is blended with carbon dioxide in an amount sufficient to produce a mixture having density within a predetermined range, in order to increase the critical velocity of the displacement process and the amount of intermediate hydrocarbon being sufficient to render the gaseous mixture at least conditionally miscible with the petroleum in the formation at the temperature and pressure of the formation. The inert gas may be methane, ethane, nitrogen, natural gas, flue gas, air or a mixture thereof.

DESCRIPTION OF THE PREFERRED EMBODIMENT

Figure 1:
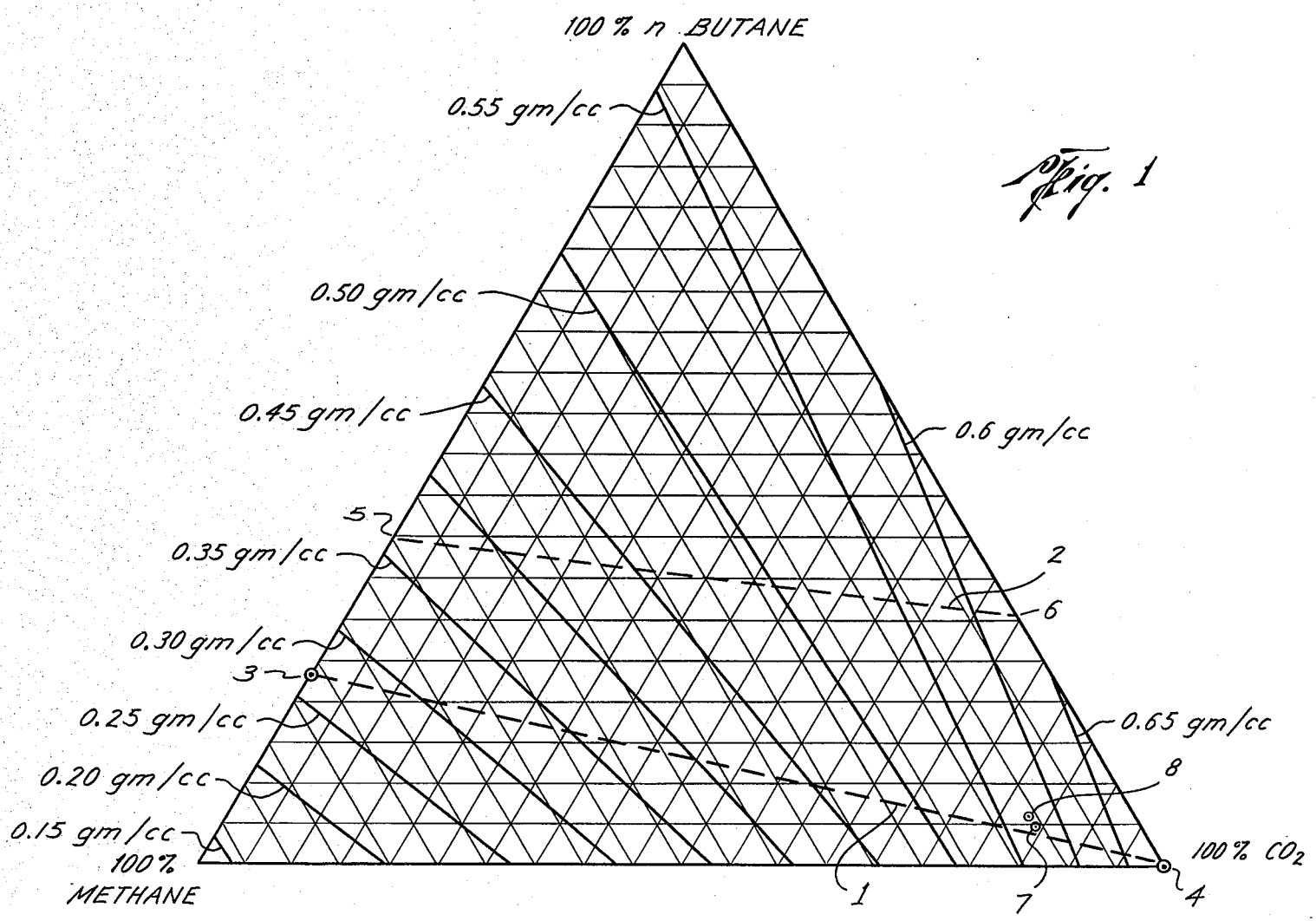
FIG. 1 illustrates a terniary diagram or three component compositional diagram for a system comprising carbon dioxide, methane, and normal butane, for a process in which carbon dioxide is just conditionally miscible with formation oil at the formation temperature and pressure.

According to certain of its broader aspects, the present invention is an enhanced oil recovery method of a conditionally miscible type which may be applied to a dipping reservoir under conditions in which conditional misciblity is attained, and which permits maintaining the advantage of gravity-stabilized gas displacement while still conducting the process at a reasonably high injection rate.

The invention resides in the discovery that it is possible to modify a system in which conditional miscibility is just attainable at formation temperature and pressure between carbon dioxide and the reservoir petroleum, either using pure carbon dioxide or carbon dioxide mixed with small amounts of inert gas or intermediate hydrocarbons, the density of the carbon dioxide displacing medium being reduced in order to increase the critical velocity, to be described herein below. The addition of inert gas to cause the density reduction causes the carbon dioxide mixture to cease being conditionally miscible with the reservoir petroleum. Sufficient intermediate hydrocarbons such as butane may then be added to the mixture to increase the miscibility while maintaining the desired lower density of the gaseous mixture.

Conditional miscibility as used in this description of my invention is distinguished from instant miscibility, which may be referred to in prior references simply as miscibility, by the fact that conditional miscibility is achieved after a series of transitional multi-phase conditions have been reached in the reservoir, wherein the injected gaseous mixture vaporizes intermediate hydrocarbon components from the formation petroleum, forming miscible transition zones of ever-increasing concentration of intermediate hydrocarbon components until a condition of true miscibility is reached, which results from the fact that the intermediate hydrocarbon concentration has been increased to the point where miscibility is attainable at formation temperature and pressure. Conditional miscibility may be achieved under certain conditions by the use of carbon dioxide alone, or, depending on the temperature, pressure and reservoir petroleum characteristics, it may be attainable using a mixture of carbon dioxide and a small amount of inert gas such as methane or nitrogen. In other reservoirs, pure carbon dioxide is not conditionally miscible with the oil at reservoir conditions and it is necessary to blend a small amount of intermediate hydrocarbons such as LPG with carbon dioxide to attain a condition of conditional miscibility.

As used in this description, inert gas means a gas whose solubility in formation petroleum is less than the solubility of carbon dioxide at the reservoir temperature and pressure. Methane, natural gas, separator gas, flue gas, nitrogen, air or mixtures thereof may be employed for this purpose. When inert gas is mixed with carbon dioxide, several results are obtained. The density of the gaseous mixture is reduced since the density of inert gas is substantially less than the density of carbon dioxide at the pressures normally encountered in subterranean formations during gas displacement operations, because of the unusual compressibility characteristic of carbon dioxide. The cost of the fluid is also reduced substantially, since carbon dioxide is more expensive than any of the inert gases discussed above. Unfortunately, since the inert gases are less soluble in oil than is carbon dioxide, the mixture of inert gas and carbon dioxide is less miscible with petroleum than is pure carbon dioxide. If carbon dioxide is conditionally miscible with petroleum at pressures below the formation pressure at formation temperature, then mixtures of inert gas and carbon dioxide may be formulated which are still conditionally miscible with formation petroleum at the formation temperature. If carbon dioxide is conditionally miscible at the formation temperature and pressure, but becomes immiscible at pressures only slightly less than formation pressure, then the addition of even a small amount of inert gas to carbon dioxide results in a mixture which is not conditionally miscible with the formation petroleum at formation temperature and pressure. If carbon dioxide is not conditionally miscible with formation petroleum at formation temperature and pressure, then a mixture of even a small amount of inert gas and carbon dioxide will not be miscible with formation petroleum at formation temperature and pressure.

As used in this description of my invention, intermediate hydrocarbon means any hydrocarbon whose molecular weight is intermediate between the formation petroleum and either carbon dioxide or the inert gas. Hydrocarbons having from 2 to 6 and preferably from 3 to 5 carbon atoms including mixtures thereof are preferred intermediate hydrocarbons for my process. Commercial mixtures such as liquified petroleum gas or LPG may also be used. Either paraffinic or aromatic hydrocarbons are satisfactory in performance, although paraffinic hydrocarbons are the usual choice because of much lower cost.

Any enhanced recovery involving flooding with a gaseous oil displacing fluid, there is a serious problem of viscous fingering, which means that the less viscous gaseous displacing fluid invades the formation petroleum in an irregular fashion, which resembles the formation of fingers of solvent invading the bank of petroleum. It is possible to conduct a gaseous displacing process in a dipping reservoir, especially if the dip angle is relatively large, e.g., greater than 5° and preferably greater than 10°, so as to accomplish stabilization of the interface between the injected fluid and the formation petroleum by gravitational forces. For any given set of conditions, there is a critical velocity below which downward displacement of petroleum with a gaseous oil displacing medium is stabilized by gravitional forces. This critical velocity is defined by the following formula:

$$V_c = 2.741\ \kappa\Delta\rho\ \mathrm{Sin}\ \theta/\phi\Delta\mu$$

$V_c$ = critical velocity, ft./day
$\kappa$ = permeability, darcies
$\phi$ = mobile fluid porosity, ($\Phi[1.0\text{-}S_{WR}\text{-}S_{OR}]$), dimensionless
$\theta$ = reservoir dip angle, degrees
$\Delta\rho$ = density difference between in-place fluid (oil) and displacing fluid ($CO_2$), g/cm$^3$
$\Delta\mu$ = viscosity difference between in-place fluid (oil) and displacing fluid ($CO_2$), cp.

Under many conditions, the injected carbon dioxide (or mixture of carbon dioxide with either inert gas or intermediate hydrocarbons, and depending on the minimal miscible pressure for carbon dioxide at reservoir conditions) is conditionally miscible with the inplace crude. Because carbon dioxide is a highly compressible gas, the density of carbon dioxide at relatively higher pressures and normal formation temperatures may be very close to the density of petroleum present in the formation. The closer the density values are, the lower is the value of $\Delta\rho$ in the equation above for critical velocity. Thus, when the density of carbon dioxide is very close to the density of the formation petroleum, $\Delta\rho$ is low and so the critical velocity is too low for practical application in a field project. Even though carbon dioxide may be conditionally miscible with petroleum at formation conditions, the injection of carbon dioxide in a displacement process in which the linear velocity at which the slug of carbon dioxide moves through the formation is greater than the critical velocity defined by the above equation, results in severe viscous fingering which causes mixing between the injected slug of carbon dioxide and the formation petroleum. Eventually, the integrity of the slug is destroyed, and the displacement process would cease to function as a miscible oil displacement process.

I have discovered that it is possible to add sufficient inert gas such as methane or nitrogen to a carbon dioxide slug to reduce the density of the slug sufficiently to increase the critical velocity of the oil displacement process to a value which permits operating the enhanced recovery process in the field at an economically acceptable level. If carbon dioxide is just conditionally miscible with formation petroleum at the formation temperature and pressure (i.e. if carbon dioxide looses conditional miscibility at formation temperature at pressures only slightly less than formation pressure) then the addition of inert gas to carbon dioxide in a sufficient amount to reduce the density of the mixture in order to achieve the desired increase in the critical velocity, results in the mixture losing its ability to attain conditional miscibility or multi-contact miscibility with the formation petroleum at formation temperature and pressure. I have discovered that it is possible to regain miscibility by adding a very small amount of intermediate hydrocarbons, e.g. C2 to C6 and preferably C3 to C5 paraffinic hydrocarbons such as propane, butane or pentane, without causing a serious loss in fluid density. By this process, it is possible to prepare a blended mixture of carbon dioxide having essentially the desired density, and still maintain conditional miscibility between the solvent blend and the in-place oil. Use of the critically blended mixture of carbon dioxide, solvent and inert gas allows flooding in dipping reservoirs without the sacrifice of the beneficial effect of gravity stabilization of the miscible flood, while still operating at an injection rate sufficiently high to insure that the flood is concluded in a reasonable time.

The method of operating according to my process can best be understood by turning to the attached FIG. 1, which shows a terniary diagram or three component compositional diagram for carbon dioxide, methane and normal butane. This data was obtained during the study of a reservoir whose temperature is 160° F. (71.1° C.) and pressure is 3350 pounds per square inch absolute. The formation porosity is 0.22, $S_{wr}$=0.30, $S_{or}$=0.05, $\rho_{oil}$=0.72 g/cm, $\kappa$=500 millidarcies, formation dip angle=33°, and $\mu_{oil}$=0.50 centipoise. At these conditions, pure carbon dioxide is just conditionally miscible with the formation petroleum at the above-stated temperature and pressure. At these conditions, carbon dioxide has a density of 0.692 grams per cubic centimeter and a viscosity of 0.06 cp.

In applying the process of my invention, it is necessary first to define the minimum multi-contact miscibility line, which is designated as line 1 in FIG. 1. This line is anchored on the right side of the diagram by finding the composition of $CO_2$ and intermediate hydrocarbon or $CO_2$ and inert gas which is just miscible at formation temperature and pressure with the formation petroleum. In the example illustrated in FIG. 1, this point, designated as point 4 in the drawing, corresponds to 100% carbon dioxide. As will be seen below, the composition of carbon dioxide and inert gas or carbon dioxide and intermediate hydrocarbon, n-butane in this example, which is just miscible with petroleum at formation conditions often does not coincide with the 100% carbon dioxide point. The other end of line 1 is anchored along the side of the terniary diagram connecting butane and methane, at the point corresponding to a mixture of methane and n-butane having the same weight average critical temperature as the critical temperature of the $CO_2$ component defined above; that is the $CO_2$ mixture which is just miscible with formation petroleum at formation conditions. In the specific illustration of FIG. 1, the anchor point 3 for line 1 corresponds to the mixture of methane and normal butane having a weight average critical temperature the same as essentially pure carbon dioxide (548° R). The mixture of methane and normal butane meeting this requirement in this embodiment contains 47% (by weight) or 76.5% (mole) methane. The compositional diagram of FIG. 1 is plotted using mole % of all components. The density of the mixture corresponding to point 3 on FIG. 1 is 0.268 grams per cubic centimeter.

The line connecting points 3 and point 4 is defined as the minimum multi-contact miscibility line. Any composition of the 3 components falling below this line cannot achieve conditional or multi-contact miscibility with formation petroleum at the temperature and pressure of the formation. Any mixture on or above the line can achieve multi-contact miscibility with formation petroleum. Although miscibility at distances substantially above line 1 is easily attained in the formation, the cost of the solvent system increases substantially with increased butane content, and so it is desired to operate using a composition which is only slightly above the minimum multi-contact miscibility line 1.

Figure 2:
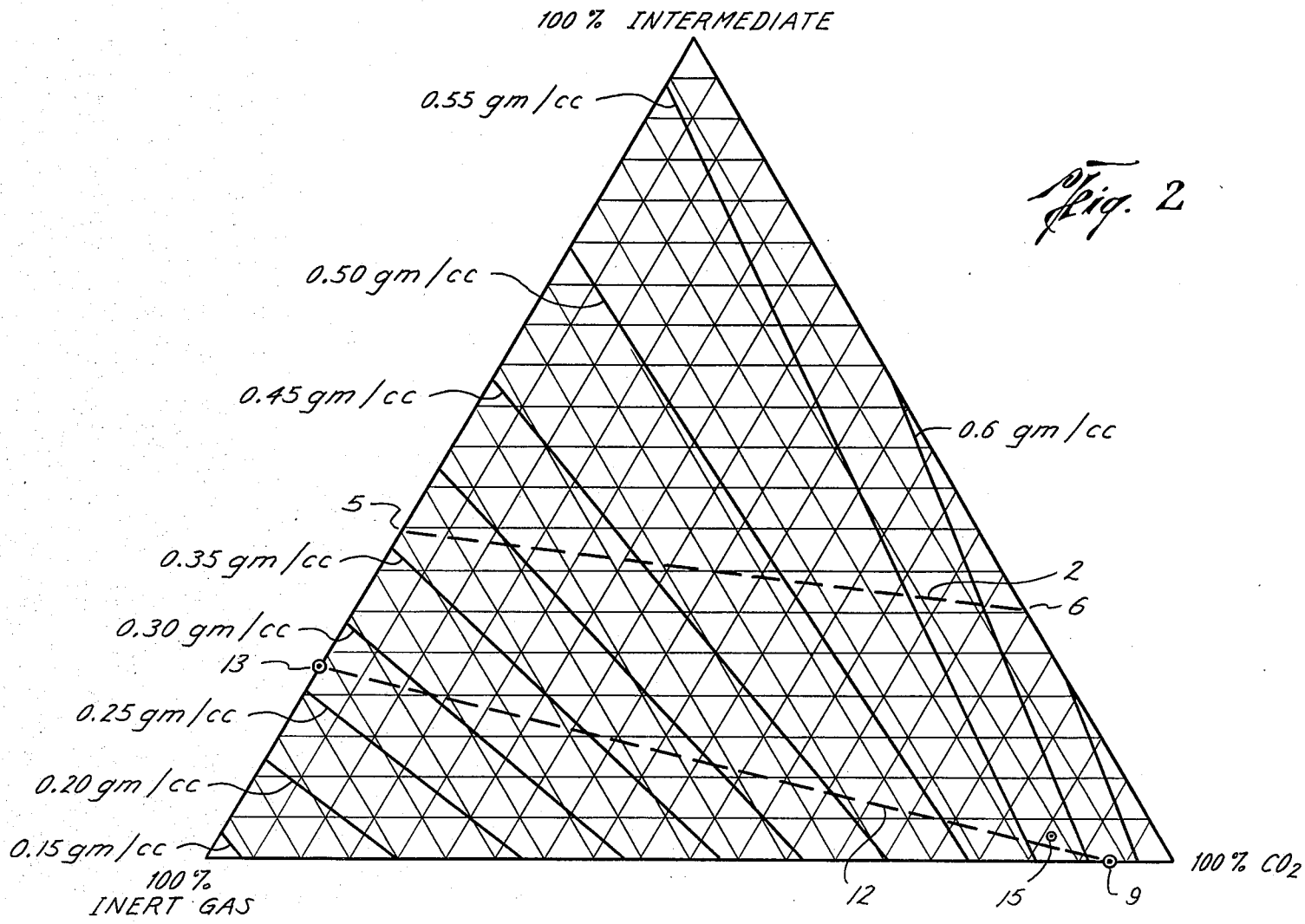
FIG. 2 illustrates a hypothetical terniary diagram or three component compositional diagram for carbon dioxide, inert gas and intermediate hydrocarbons for a system in which a mixture of carbon dioxide and a small amount of inert gas is just conditionally miscible at the temperature and pressure of the formation.

FIG. 2 illustrates a terniary diagram or three component compositional diagram for inert gas, intermediates and carbon dioxide, for a system in which carbon dioxide is miscible at formation temperatures and at pressures slightly less than formation pressure. This means that it is possible to blend a small amount of inert gas with carbon dioxide and still attain multi-contact or conditional miscibility with formation oil at the temperature and pressure of the formation. It is important to note, however, that the minimum multi-contact miscibility line, designated as 12 in FIG. 2, is anchored at a point 9 which is moved toward the 100% inert gas vertex along the bottom of the terniary diagram, and as a consequence, the minimum multi-contact miscibility line 12 is lower on this diagram than line 1 of FIG. 1. Point 13, the other anchor point for line 12, may also occur at a slightly different point since it corresponds to the composition of the inert gas and intermediate hydrocarbon component having a weight average critical temperature equal to the mixture corresponding to point 9 on FIG. 2. The precise location on this point depends on the particular inert gas and intermediate hydrocarbon employed. If the inert gas is nitrogen, anchor point 13 will be moved in an upward direction, indicating greater quantities of intermediate hydrocarbons are required to to be added to a mixture of carbon dioxide and nitrogen in order to attain miscibility than is required to attain miscibility of a mixture of carbon dioxide and methane.

Figure 3:
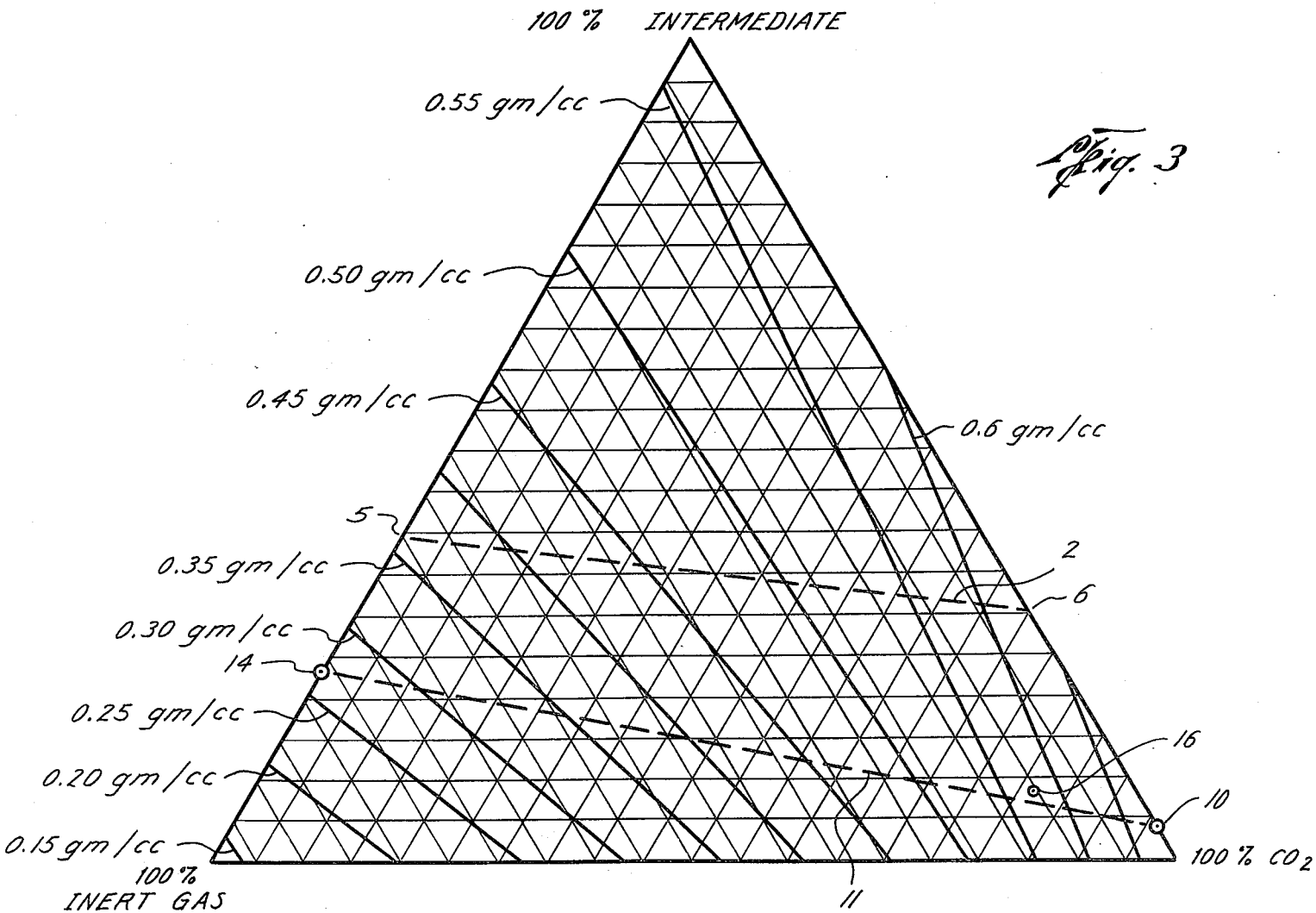
FIG. 3 illustrates a hypothetical terniary diagram or three component compositional diagram for inert gas, intermediate hydrocarbon and carbon dioxide for a system in which carbon dioxide is not conditionally miscible alone with the formation petroleum, but is rendered miscible by mixing therewith a small amount of intermediate hydrocarbon.

In FIG. 3, yet another condition is defined, in which carbon dioxide is not quite miscible with formation petroleum at the temperature and pressure of the formation. In this embodiment, it is necessary to incorporate about 5% intermediate hydrocarbon with carbon dioxide in order to form a mixture which is just miscible with the formation petroleum at the temperature and pressure of the formation. Thus, the minimum multi-contact line 11 in FIG. 3, is somewhat higher than in FIG. 1 or 2. Point 14, which constitutes the other anchor point for line 11 in FIG. 3, may also be at a different point along the inert gas-intermediate gas edge of the terniary diagram, depending on the particular inert gas and intermediate hydrocarbon employed. It should, however, correspond to the composition of inert gas and intermediate having a weight average critical temperature equal to the temperature of the mixture corresponding to point 10 on FIG. 3.

The following illustrates the method of determining the optimum concentration for a particular embodiment of my invention, and illustrates why such method is needed and the nature of results obtainable thereby. In the reservoir described above in connection with the data on which FIG. 1 is based, at the conditions listed, the critical velocity for pure carbon dioxide would be 0.33 feet per day. In application of a process to a reservoir having characteristics such as those described above, using 500-foot well spacings, injection of pure carbon dioxide into the reservoir at a velocity at or slightly below the critical velocity would require 1515 days (4.2 years) before breakthrough of the injected solvent occurred. Although the process would be efficient, the economics would be very poor because of the time required to complete the flood. By application of the process of my invention, it is possible to recover essentially the same amount of oil in a much shorter time. By blending a sufficient amount of inert gas to reduce the solvent density from 0.692 grams per cubic centimeter to 0.57 grams per cubic centimeter, the critical velocity is increased from 0.335 feet per day to 1.8 feet per day. This means the time required to flood a pattern using 500-foot well spacing is reduced from 4.2 years to 0.8 years. The economics of a field project are improved greatly by a reduction in time of this magnitude.

The following describes specifically how the process of my invention is employed in designing a flood to be performed in a reservoir under the above-described conditions. Any gaseous mixture of the inert gas (methane the embodiment disclosed in FIG. 1) and the intermediate component (normal butane in this example) that would be conditionally miscible with the reservoir fluid at the operating conditions would be miscible in all proportions with carbon dioxide and the resultant mixture would also be miscible with the reservoir fluid. A desired mixture of inert gas and intermediate hydrocarbon component corresponding to point 3 in FIG. 1 has a weight average critical temperature the same as carbon dioxide (548° R). The mixture of methane and normal butane meeting this requirement contains 47.4 weight percent or 76.5 mole percent methane. At the operating conditions of the reservoir, 164° F. and 3350 psia, this mixture exhibits a density of 0.268 grams per cubic centimeter.

All mixtures of this blend of methane and normal butane with pure carbon dioxide would be miscible with the reservoir petroleum. In formulating the desired blend, first it is necessary to add sufficient methane to carbon dioxide to reduce the density of the carbon dioxide-methane mixture to the desired value, which is 0.57 grams per cubic centimeter. Addition of increasing amounts of methane to carbon dioxide creates mixtures which fall along the bottom of the terniary diagram FIG. 1 from point 4 toward the vertex of the diagram corresponding to 100% methane. By moving along the bottom boundary until the density falls within the indicated density limits of 0.55 and 0.60 shown on FIG. 1, one can formulate a mixture of carbon dioxide and methane having the required density. This mixture is below the minimal conditional miscibility line 1, however, and so this mixture, while exhibiting the desired density, would not exhibit conditional miscibility with the formation petroleum at the formation temperature and pressure. The next step comprises adding sufficient intermediate hydrocarbon to bring the compositional point above line 1, on FIG. 1, which results in a mixture having both the desired density and being above the conditional miscibility line.

Two mixtures were formulated according to this criteria, and their composition is indicated as points 7 and 8 on FIG. 1. Point 7 contains 83.0 percent carbon dioxide, 11.0 percent methane, and 6.0 percent normal butane. Point 8 contains 84.3% carbon dioxide, 10.7% methane and 5.0 percent normal butane. These mixtures both exhibited minimum miscibility pressures as determined by slim tube displacement tests less than 3350 psia and densities between 0.57 and 0.58 grams per cubic centimeter based on PVT cell determinations. These measurements indicate that either mixture would be a satisfactory solvent, meeting both the conditional miscibility requirement and the density requirement necessary to permit operating a conditionally miscible flood at a flood rate less than the critical velocity for the system and yet at a commercially viable rate.

Referring again to FIG. 2, it can be seen that even though under certain conditions, it is possible to attain conditional miscibility with a mixture of carbon dioxide and a small amount of inert gas, which is the composition corresponding to point 9, this composition does not initially meet the criteria of the process of my invention. Prior art teaches the desirability of adding a small amount of inert gas to carbon dioxide where this can be done without causing the mixture to cease being conditionally miscible. In order to reduce the specific gravity of the component corresponding to point 9, whose density is between about 0.60 to 0.65, it is necessary to add at least another 5% inert gas to reduce the density of the mixture to the desired 0.57 grams per cubic centimeter. The addition of this much gas, however, results in the mixture no longer being conditionally miscible at formation temperature and pressure, and so it is necessary to add 2 or 3 percent intermediates hydrocarbon to this mixture to produce a fluid of composition corresponding to point 15 on FIG. 2 which is above the minimum multi-contact miscibility line 12. It should be noted that the amount of intermediate hydrocarbon added to this mixture to produce a mixture meeting all the criteria for the process of my invention is substantially less than the amount of intermediate hydrocarbon added to the mixture shown in FIG. 1 to achieve a conditionally miscible mixture of acceptable density.

FIG. 3, which illustrates a situation in which pure carbon dioxide is not conditionally miscible with the reservoir petroleum at formation temperature and pressure, but requires the addition of about 4 percent intermediate hydrocarbon to produce a fluid mixture which is just conditionally miscible. In this instance, the process of my invention is still applied by adding sufficient inert gas to reduce the density of the first carbon dioxide-intermediate hydrocarbon mixture (point 10 in FIG. 3) to within the desired range, which requires about 11 percent inert gas. Again, this mixture is no longer conditionally miscible, and it is necessary to add an additional three percent of intermediate hydrocarbons to raise the mixture to a point above the minimum multi-contact miscibility line 11. This point 16 corresponds to about 82 percent carbon dioxide, 8 percent intermediates and 10+ percent inert gas.

It is within the scope of this invention to apply the above-described process of my invention to a dipping reservoir as disclosed above, or it can be used in a vertical displacement process in which a blanket of the solvent is established prior to the injection of the driving fluid which moves the blanket vertically downward through the reservoir.

In summary, the process of my invention concerns a conditionally miscible flood carried out by formulating a mixture of a carbon dioxide-containing gas which is just miscible with the formation petroleum with sufficient inert gas to reduce the density of the mixture to a desired level which provides a reasonably high critical velocity in the particular application, and then adding to the mixture sufficient intermediate hydrocarbons to return the mixture to a point on the terniary diagram above the minimum multi-contact miscibility line, in order to insure that the mixture of carbon dioxide, inert gas and intermediate hydrocarbons is conditionally miscible with the formation petroleum at the temperature and pressure of the formation. In any of the embodiments described herein, after an amount of the slug has been formulated and injected into the formation which is sufficient to establish a discrete bank of solvent within the formation, there is introduced into the formation a driving fluid such as inert gas or water to displace the slug of solvent through the formation, which in turn displaces petroleum through the formation to the production well from which petroleum is recovered to the surface of the earth. By operating in accordance with the above disclosure, a highly efficient rapid displacement of reservoir oil is realized using a minimum cost solvent composition.

While my invention has been described in terms of a number of illustrative embodiments, it is clearly not so limited since many variations thereof will be apparent to persons skilled in the art of oil recovery. It is my intention and desire that my invention be limited and restricted only by those limitations and restrictions in the claims appended herein immediately hereinafter below.

I claim:

1. A process for recovering petroleum from a subterranean, permeable, petroleum reservoir penetrated by at least one injection well and by at least one production well, comprising the steps of:

a. injecting into the reservoir via said injection well a gaseous displacing fluid comprising a mixture of carbon dioxide, nitrogen, and an intermediate hydrocarbon wherein (1) the nitrogen is blended with carbon dioxide in a concentration sufficient to produce a mixture whose density is within a predetermined range, and (2) the concentration of intermediate hydrocarbon is at least sufficient to render the gaseous mixture conditionally miscible with the petroleum in the formation at the temperature and pressure of the formation, and b. injecting a drive fluid to drive the displacing fluid and petroleum through the formation, and c. recovering petroleum displaced by the displacing fluid from the formation via the producing well.

2. A method as recited in claim 1 wherein the intermediate hydrocarbon contains from 2 to 6 carbon atoms including mixtures thereof.

3. A method as recited in claim 1 wherein the intermediate hydrocarbon contains from 3 to 5 carbon atoms, including mixtures thereof.

4. A method as recited in claim 1 wherein the intermediate hydrocarbon is liquified petroleum gas.

5. A method of recovering petroleum from a subterranean, petroleum-containing, permeable formation, said formation being penetrated by at least one injection well and by at least one production well, said formation forming an angle with a horizontal plane of at least 5 degrees, comprising injecting a gaseous, carbon dioxide-containing oil displacement fluid into the formation which is at least conditionally miscible with the petroleum at formation temperature and pressure, said carbon dioxide-containing gaseous displacing fluid being injected up-dip so as to cause the gaseous displacement to occur in a downward direction, said displacement process being conducted at an injection rate which causes the velocity of the solvent through the formation to be less than the critical velocity as determined from the formation permeability, mobile fluid porosity, reservoir dip angle, difference between petroleum density and displacing fluid density, and viscosity difference between formation fluid and displacing fluid, wherein the improvement comprises:

blending sufficient inert gas with the carbon dioxide-containing oil displacing fluid to reduce the density of the displacing fluid in order to increase the critical velocity of the displacement process to a predetermined value, and blending sufficient intermediate hydrocarbons with the mixture of carbon dioxide-containing oil displacing fluid and inert gas to ensure that the mixture is conditionally miscible with the formation petroleum at the temperature and pressure conditions existing in the reservoir.

6. A method as recited in claim 5 wherein the inert gas is selected from the group consisting of methane, ethane, nitrogen, natural gas, flue gas, air, and mixtures thereof.

7. A method as recited in claim 6 wherein the inert gas is methane.

8. A method as recited in claim 6 wherein the inert gas is nitrogen.

9. A method as recited in claim 5 wherein the intermediate hydrocarbon contains from 2 to 6 hydrocarbons including mixtures thereof.

10. A method as recited in claim 5 wherein the intermediate hydrocarbon is liquefied petroleum gas.

11. In a method for recovering petroleum from a subterranean, dipping, petroleum-containing formation by process involving injecting a carbon dioxide-containing oil displacing fluid into the formation to displace petroleum in a downward direction, said oil displacing fluid being at least conditionally miscible with the formation, wherein the improvement for increasing the critical velocity of this displacement process comprises:

blending sufficient inert gas with the carbon dioxide fluid to decrease the density thereof in order to reduce the critical velocity to a predetermined value, the blending sufficient intermediate hydrocarbons with the mixture of carbon dioxide and inert gas to ensure that that said mixture is conditionally miscible with formation petroleum at the conditions of temperature and pressure in the formation.

12. A method as recited in claim 11 wherein the inert gas is selected from the group consisting of methane, ethane, nitrogen, natural gas, flue gas, air, and mixtures thereof.

13. A method as recited in claim 12 wherein the inert gas is methane.

14. A method as recited in claim 12 wherein the inert gas is nitrogen.

15. A method as recited in claim 11 wherein the intermediate hydrocarbon is a hydrocarbon containing from 2 to 6 carbon atoms, liquefied petroleum gas or mixtures thereof.

* * * * *